United States Patent [19]

Gentry et al.

[11] Patent Number: 4,488,125

[45] Date of Patent: Dec. 11, 1984

[54] COAXIAL CABLE STRUCTURES AND METHODS FOR MANUFACTURING THE SAME

[75] Inventors: John M. Gentry, Candler; Virgil T. Bolick, Jr., Asheville; Kenneth W. Brownell, Jr., Enka, all of N.C.

[73] Assignee: Brand-Rex Company, Willimantic, Conn.

[21] Appl. No.: 395,368

[22] Filed: Jul. 6, 1982

[51] Int. Cl.[3] ..... H01P 3/06

[52] U.S. Cl. ..... 333/1; 174/115; 174/117 F; 333/243

[58] Field of Search ..... 333/1, 243; 174/115, 174/117 F

[56] References Cited

U.S. PATENT DOCUMENTS

| | | | |
|---|---|---|---|
| 3,735,022 | 5/1973 | Estep | 333/243 X |
| 3,775,552 | 11/1973 | Schumacher . | |
| 3,896,261 | 7/1975 | Cole | 174/115 |
| 4,234,759 | 11/1980 | Harlow | 174/115 X |
| 4,317,737 | 2/1982 | Bogese et al. . | |

FOREIGN PATENT DOCUMENTS

| | | | |
|---|---|---|---|
| 1011416 | 5/1977 | Canada | 174/115 |
| 469043 | 11/1928 | Fed. Rep. of Germany | 174/115 |

OTHER PUBLICATIONS

Electron Packaging and Production, May 1975, p. 28–Advertisement for a coaxial ribbon Cable sold by AMP Incorporated.

Amdahl Corporation, drawing No. B1044–000, showing a cable structure.

*Primary Examiner*—Paul L. Gensler

*Attorney, Agent, or Firm*—David M. Carter; Alan Stempel

[57] ABSTRACT

Novel discrete coaxial cable and coaxial cable assembly constructions are disclosed. One preferred embodiment of the invention is a flat coaxial cable assembly. The invention also provides a novel method for manufacturing the coaxial elements which are the primary structural components of the coaxial cables and assemblies. In this method a signal wire and at least one drain wire are embedded in a minor matrix of dielectric material. A portion of the minor matrix material is peeled or skived away to expose the drain wire or wires. The resulting product is then wrapped in metal foil so that the foil makes electrical contact with the exposed drain wires. This step yields a completed coaxial element. A single element may be embedded in a major matrix of dielectric to yield a coaxial cable or several elements may be so embedded to yield a coaxial cable assembly.

22 Claims, 11 Drawing Figures

FIG. 4
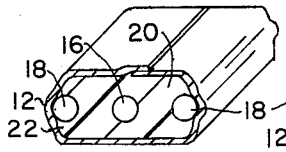
FIG. 7
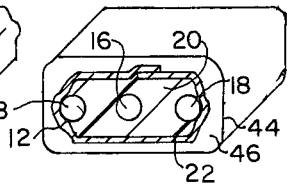
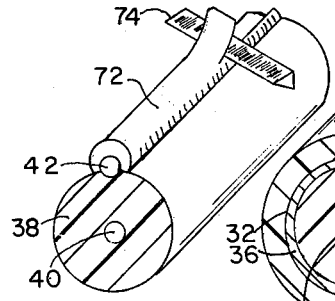
FIG. 9
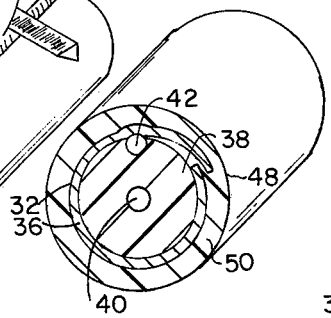
FIG. 11
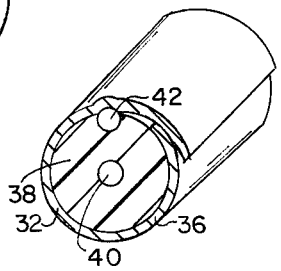
FIG. 10
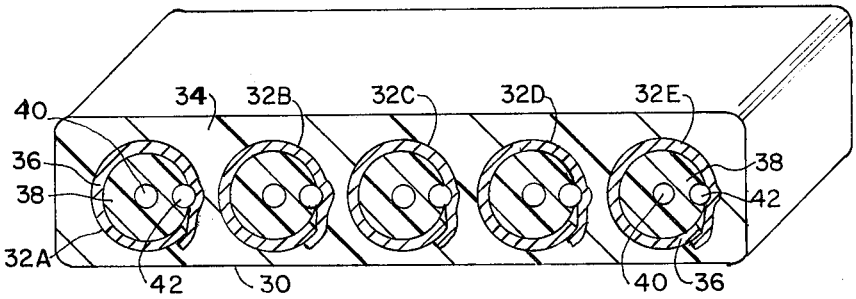
FIG. 8

COAXIAL CABLE STRUCTURES AND METHODS FOR MANUFACTURING THE SAME

BACKGROUND OF THE INVENTION

1. Field of the Invention

The present invention relates to electrical cables. The invention relates, more particularly, to a novel coaxial cable structure and to flat coaxial cable assemblies comprising a plurality of such coaxial cables, as well as methods for manufacturing the same.

2. Description of the Prior Art

Flat coaxial cable assemblies are well known in the prior art. Generally, such cables include a spaced-apart, parallel and coplanar array of parallel, insulated signal wires. The signal wires are provided either with individual surrounding shield conductors or with a single shield common to all of the signal conductors. Usually, the shields consist of metal foil. In addition, in order to facilitate termination of the shields with electrical connectors, as well as the signal wires, it is usual to provide one or more drain wires which are in intimate electrical contact with the shield or shields. Thus, in cables wherein each signal wire is provided with its own shield, there will usually be a drain wire associated with each shield.

It has long been appreciated that in order to facilitate the termination of flat cables, particularly mass or gang termination of cables using automated installation tooling, it is necessary for all of the conductors at a stripped cable end to be located at predictable locations. This requirement is easily met in the case of simple, non-coaxial, flat cable where one is faced simply with a parallel, spaced array of wire conductors. In the case of flat, coaxial cable having drain wires, however, it has proven difficult to precisely locate both the signal and drain wires within the cable.

For example, in some prior art cable assemblies, the drain wires sprial around the associated signal wires. It is obvious that for any randomly chosen cross section of such a cable, the precise location of all of the drain wires cannot be predicted. Accordingly, cables of this variety cannot easily be terminated, except by hand.

In another type of flat, coaxial cable assembly, linear drain wires are provided which occupy precisely specified locations within the cable. Cable assemblies of this type are constructed by first manufacturing the individual coaxial cables which make up the assembly and then embedding the cables in a common dielectric matrix. Each individual coaxial cable is made by placing an insulated signal wire and an uninsulated drain wire in parallel alignment and then wrapping the wire pair in a metal foil shield. The completed coaxial cables are placed in the assembly in such a way that all of the signal and drain wire pairs are similarly oriented, thus making the location of each predictable. It will be appreciated, however, that cable assemblies of this type are difficult to manufacture because it is possible for the drain wire in each coaxial cable to migrate underneath the foil shield, with such migration being a particularly acute problem during the step of foil wrapping itself. Of course, if a drain wire does move in this way during manufacture, it will not occupy its assigned location in the cable assembly.

In view of the foregoing description of the state of the art, it is clear that there is a need for a flat, flexible, coaxial cable assembly in which all conductors are located at predictable locations, in order to facilitate termination, and which may be easily and simply manufactured.

The objects of the present invention, are, accordingly, to provide such a cable assembly, as well as methods for manufacturing the same.

SUMMARY OF THE INVENTION

The present invention satisfies the above-stated objects by providing a flat, coaxial cable assembly in which all of the conductors occupy predictable locations. The assembly, which is easily manufactured, comprises a plurality of individual coaxial cables which are embedded in a flat, elongate, supporting major matrix of dielectric material. Each of the individual coaxial cables comprise a signal wire and at least one drain wire which is spaced from and parallel to the signal wire. The signal and drain wires are longitudinally embedded in an elongate minor matrix of dielectric material in such a way that the drain wires are partially exposed through the outer surface of the minor matrix. A conductive shield overlies the elongate minor matrix and makes electrical contact with the partially exposed drain wires.

The individual coaxial cable elements of this novel assembly may be manufactured by positioning at least one drain wire in spaced-apart, parallel relationship to a signal wire and then embedding the signal and drain wires in a dielectric material. A portion of the outer surface of the dielectric matrix is selectively removed in order to partially expose the drain wires. Then, the cable is overlaid with a shield of conductive material in such a way that the shield makes electrically conductive contact with the partially exposed drain wires.

To fabricate the finished flat, coaxial cable assembly, a plurality of individual cable elements are positioned in a spaced-apart, parallel, coplanar array and then embedded in a major matrix of dielectric.

In addition to the foregoing, it is, of course, within the scope of the invention to produce coaxial cables, rather than coaxial cable assemblies, by overlaying a lone coaxial cable element, produced as described above, with an outer sheath of dielectric material. Additionally, it is within the scope of the invention to produce coaxial cable assemblies having non-planar configurations, should this be desired.

BRIEF DESCRIPTION OF THE DRAWINGS

FIG. 4 is a cross-sectional view of a completed coaxial element according to the invention.

FIG. 7 is a cross-section view of one embodiment of an individual coaxial cable according to the invention.

FIG. 8 is a cross-sectional view of a still further embodiment of a flat, coaxial cable assembly according to the invention.

FIG. 9 illustrates a further embodiment of a coaxial element according to the invention during a state of its manufacture.

FIG. 10 illustrates, in cross-section, another embodiment of a coaxial element according to the invention.

FIG. 11 is a cross-sectional view of a further embodiment of an individual coaxial cable according to the invention.

DETAILED DESCRIPTION OF THE PREFERRED EMBODIMENTS

Figure 1:
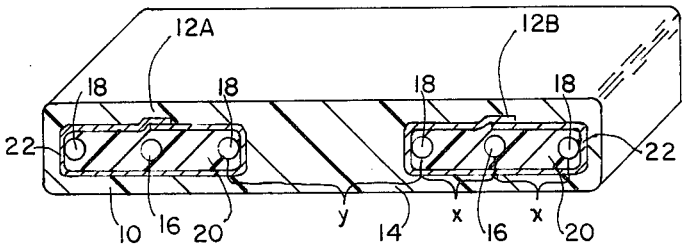
FIG. 1 is a cross-sectional view of one embodiment of a flat, coaxial cable assembly according to the invention.

Turning now to the drawings in detail, FIG. 1 is a cross-sectional view illustrating one embodiment of a flat, coaxial cable assembly according to the invention. The assembly 10 comprises a pair of coaxial elements 12A and 12B (or simply 12 when referred to generally) which are embedded in a supporting major matrix 14 of dielectric material, PVC, for example. Each of the coaxial elements 12 comprises a signal wire 16 and a pair of drain wires 18, which are spaced from and parallel to the signal wire. The signal and drain wires are longitudinally embedded in an elongate minor matrix 20 of dielectric material, which may also be PVC, for example. Very importantly, while the drain wires 18 are immobilized by the minor matrix in which they are embedded, they are partially exposed through the outer surface of the minor matrix. In this way, the drain wires are able to be placed in electrically conductive contact with a conductive shield 22, which overlies the elongate minor matrix 20. The shield 22 is preferably composed of metal foil.

While the coaxial cable assembly 10 comprises only two coaxial elements, it will be appreciated that as many additional coaxial elements may be provided as desired. Further, the spacing or pitch of the wires within the assembly can be modified to meet specific requirements. For example, while the pitch y between drain wires in neighboring coaxial elements is shown as being greater than the pitch x between the signal and drain wires within an element, the coaxial elements could be moved closer together in order to make the pitch between all of the wires uniform.

Figure 2:
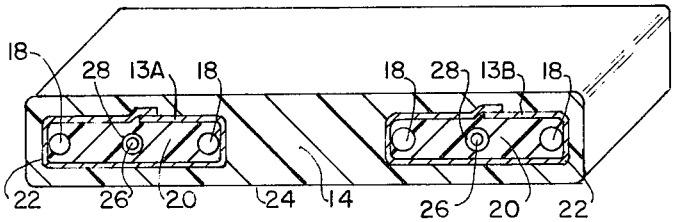
FIG. 2 is a cross-sectional view of a modification of the cable assembly depicted in FIG. 1.

FIG. 2 illustrates a possible modification of the coaxial cable assembly depicted in FIG. 1. The assembly 24 is identical to the assembly 10, except that in the coaxial elements 13A and 13B the signal wires 26, which are of a smaller gauge than the signal wires 16, are overlayed with insulation 28. The insulation 28, which is of a different composition than the dielectric 20, can serve two purposes. First by proper selection of material and dimension, the insulation 28 can be employed to finely adjust the dielectric constant of the insulation surrounding the signal wire, which by implication also finely adjusts the impedance of the coaxial element. Second, if the insulation 28 is comprised of a material which does not adhere to the insulation 20, it is possible to strip the end of the cable assembly in such a way that the drain wires are fully exposed but the signal wires retain their insulation sheaths 28. For example, the insulation 28 might be polyethylene and the insulation 20 PVC. In this modification of the cable assembly, the signal wires 26 are of reduced gauge both in order to make room for the insulation 28 and in order to reduce cable impedance.

FIG. 8, which is a cross-sectional view of a coaxial cable assembly 30, illustrates another embodiment of the invention. Here again, a plurality of coaxial elements 32A through 32E (or simple 32 when referred to generally), are longitudinally embedded in a major matrix of dielectric material 34. Each coaxial element 32 is similar to the elements 12 of FIG. 1, including an outer conductive shield 36, a minor dielectric matrix 38, a signal wire 40, and a drain wire 42. FIG. 8 is intended to show that a single drain wire may be employed for the purpose of terminating the shield 36 just as advantageously as the pair of drain wires 18 depicted in FIG. 1. Indeed, the number of drain wires employed is not critical and will be dictated mainly by the design of the connector to be used for terminating the cable assembly. Further, the cross-sectional geometry of the coaxial elements is also to a large extent not critical, and circular elements 32 may be used rather than rectangular elements 12, it being recognized that element impedance will be governed somewhat by the element's geometry.

While the invention finds its greatest utility in the provision of novel coaxial cable assemblies, it will be appreciated that novel discrete coaxial cable structures are within the scope of the invention as well. For example, as shown in FIGS. 4 and 7, a discrete coaxial cable 44 may be fabricated which comprises a single coaxial element 12, which is surrounded by a major matrix of insulation 46. Similarly, as shown in FIGS. 10 and 11, a coaxial cable 48 can be fabricated by overlaying a coaxial element 32 with a layer of dielectric 50.

Figure 5:
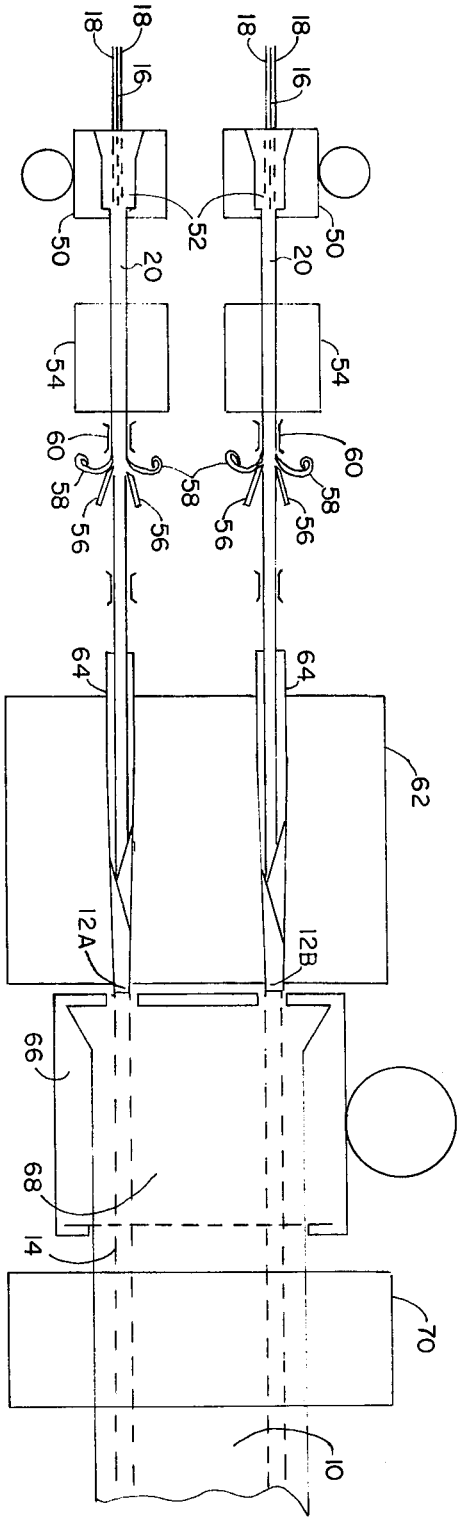
FIG. 5 is a diagramatic view, from the top, depicting a method for manufacturing flat, coaxial cable assemblies according to the invention.
Figure 6:
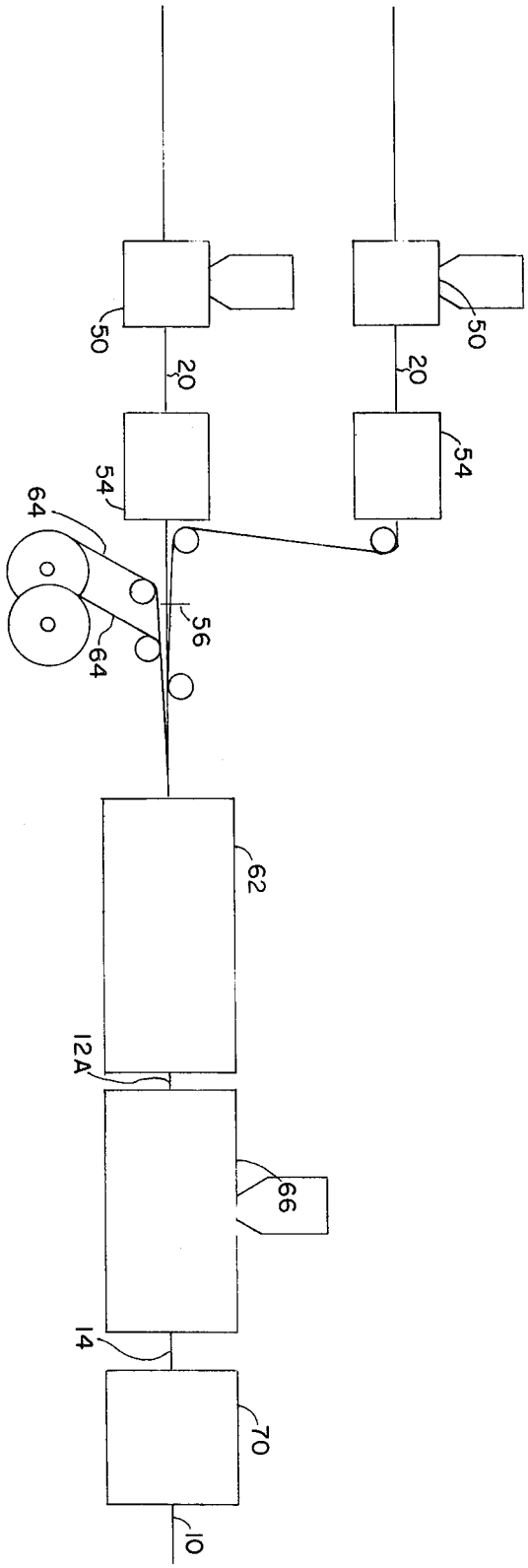
FIG. 6 is a diagramatic view, from the side, which further depicts the method shown in FIG. 5.

The novel coaxial cables and coaxial cable assemblies provided by the invention are relatively simple and economical to manufacture. FIGS. 5 and 6 depict, schematically, a method for producing flat coaxial cable assemblies such as the assembly 10 shown in FIG. 1.

Each of the coaxial elements 12A and 12B are prepared in the following manner. A pair of drain wires 18 and a signal wire 16 are fed, in spaced-apart, parallel and coplanar alignment, to a first extruder 50, where they pass through a pressurized reservoir of dielectric material 52. The wire set emerges from the extruder embedded in a minor matrix of dielectric material 20 which is solidified by passage through a water bath 54.

Figure 3:
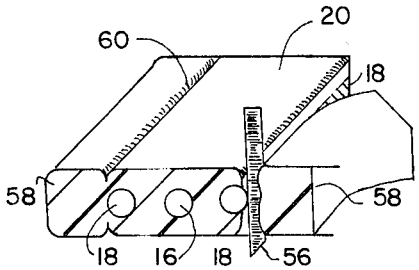
FIG. 3 illustrates one embodiment of a coaxial element according to the invention during a stage of its manufacture.

The coaxial element precursor next passes through a blade set 56 which removes portions of the minor matrix 20 so that the drain wires are partially exposed through the new outer surface of the matrix, as best shown in FIG. 3. It has been found to be preferable to extrude the minor matrix 20 in such a way that it comprises a main portion and protuberant selvage portions 58 which are separable from the main portion, with each of the drain wires 18 being partially embedded in the main portion and partially in a selvage portion, as shown in FIG. 3. It has been found that the constricted transition zones 60 between the main and selvage portions of the minor matrix assist in guiding the blades 56. In addition, those skilled in the art will recognize that with the proper selection of dielectric material, it would be possible to peel off the selvage portions 58, eliminating the requirement for the blades 56.

The as yet incomplete coaxial element next passes through a furling block 62 where a metal foil tape 64 is applied around the minor matrix 20 to form the conductive shield 22. The foil tape 64 is pressed into electrically conductive contact with the partially exposed drain wires 18 by the furler 62. It should be noted that, in contrast to prior art coaxial cable forming methods, the drain wires are at this point held immobile by the minor matrix 20. In this way, migration of the drain wires during the foil furling step is eliminated, assuring that the various wires in the finished coaxial cable assembly will occupy precisely their preassigned locations. Cable assemblies manufactured in this fashion are thus easily mass or gang terminated using automated installation tooling.

The now complete coaxial elements 12A and 12B are next drawn into an extruder 66 which includes a reservoir of pressurized thermoplastic resin 68. The elements emerge from the extruder embedded in a ribbonlike major matrix 14 of the thermoplastic resin. After cooling in a water bath 70, the manufacture of the coaxial cable assembly 10 is complete.

The manufacture of a coaxial cable assembly such as 30 of FIG. 8 is accomplished in much the same fashion as that just described for the assembly 10. Of course, in this instance the coaxial element precursor which emerges from the initial set of extruders is configured as shown in FIG. 9. A single protuberant selvage portion 72 is separated from the main portion of the minor matrix 38 by a knife 74 to partially expose a lone drain wire 42 which is embedded in the matrix. Next metal foil is applied in order to form the coaxial element 32 shown in FIG. 10. A desired number of coaxial elements 32 are then fed into an extruder where they are embedded in a major matrix of dielectric material 34 to yield, after cooling, the finished coaxial cable assembly.

While there have been shown and described only several embodiments of the invention, changes and modifications in construction and method will now be obvious to those skilled in the art which do not depart from the scope of the invention. It is intended by the appended claims to cover all such changes and modifications.

We claim:

1. A coaxial cable comprising:

(a) a signal wire;

(b) at least one substantially straight drain wire spaced apart from and parallel to said signal wire; said drain wire being in the same plane with said signal wire for the entire length of said cable;

(c) an elongated minor matrix of dielectric material, within which said signal and drain wires are longitudinally embedded, said minor matrix having an outer surface through which each of said drain wires is partially exposed; substantially more of the surface of each of said drain wires being embedded than being exposed;

(d) a conductive shield overlying said elongate minor matrix, in electrical contact with substantially all of the surface of the part of the exposed portion of each of said drain wires facing said shield; and, (e) a major matrix of dielectric material overlying said shield.

2. The coaxial cable of claim 1 having a substantially flat configuration.

3. The coaxial cable of claim 1 having a pair of drain wires.

4. The coaxial cable of claim 3, wherein said signal wire is positioned between said two drain wires.

5. The coaxial cable of claim 4, wherein said signal and drain wires are coplanar.

6. A coaxial cable assembly, comprising:

(a) a plurality of parallel spaced apart signal wires;

(b) at least one substantially straight drain wire associated with each signal wire, each such drain wire being parallel to and spaced apart from the signal wire with which it is associated along the entire length of said cable;

(c) a plurality of elongate minor matrices of dielectric material, each such minor matrix having longitudinally embedded therein one of said signal wires and said drain wires associated therewith, each such minor matrix having an outer surface through which each of said drain wires is partially exposed; substantially more of the surface of each of said drain wires being embedded than being exposed;

(d) a plurality of conductive shields, each of which overlies one of said elongate minor matrices, each such shield being in electrically conductive contact with substantially all of the surface of the part of the exposed portion of each of said drain wires facing said shield; and (e) a unitary major matrix of dielectric material overlying said conductive shields.

7. A coaxial cable assembly according to claim 6, wherein said minor matrices are positioned within said major matrix so that the longitudinal axes of said minor matrices are substantially parallel.

8. A coaxial cable assembly according to claim 6, wherein said minor matrices are positioned within said major matrices so that the longitudinal axes of said minor matrices are substantially coplanar.

9. A coaxial cable assembly according to claim 6, wherein said major matrix is substantially ribbonlike.

10. A coaxial cable assembly according to claim 6, wherein each minor matrix has embedded therein a signal wire positioned between a pair of parallel drain wires.

11. A coaxial assembly according to claim 6, wherein the longitudinal axes of said signal and drain wires are parallel.

12. A coaxial assembly according to claim 6, wherein the longitudinal axes of said signal wires are coplanar.

13. A coaxial assembly according to claim 6, wherein the longitudinal axes of said drain wires are coplanar.

14. A coaxial assembly according to claim 6, wherein the longitudinal axes of said signal and drain wires are located at predetermined positions.

15. A coaxial assembly according to claim 6, wherein the longitudinal axes of said signal and drain wires are coplanar and parallel.

16. A coaxial assembly according to claim 15, wherein the longitudinal axes of said signal and drain wires are located on a predetermind center-to-center spacing.

17. A coaxial cable assembly including a plurality of coaxial elements which are embedded in a supporting major matrix of dielectric material, each of said coaxial elements comprising:

(a) a signal wire;

(b) at least one substantially straight drain wire spaced from and parallel to said signal wire along the entire length of said cable;

(c) an elongate minor matrix of dielectric material within which said signal and drain wires are longitudinally embedded, said minor matrix having an outer surface through which each of said drain wires is partially exposed; substantially more of the surface of each of said drain wires being embedded than being exposed; and (d) a conductive shield overlying said elongate minor matrix in electrically conductive contact with substantially all of the surface of the part of the exposed portion of each of said drain wires facing said shield, said major matrix overlying said conductive shield.

18. A coaxial assembly according to claim 17, wherein said plurality of coaxial elements are embedded in said supporting major matrix so that the longitudinal axes thereof are parallel and coplanar.

19. A coaxial assembly according to claim 18, wherein said assembly is substantially flat.

20. A coaxial assembly according to claim 18, wherein the longitudinal axes of said coaxial elements are located in said supporting matrix at predetermined center-to-center spacings.

21. A coaxial assembly according to claim 18, wherein the longitudinal axes of said signal and drain wires are substantially parallel, coplanar and located on a predetermined pitch.

22. A coaxial assembly according to claim 18, wherein each coaxial elements includes a pair of spaced-apart, parallel drain wires with said signal wire being positioned therebetween.

* * * * *